US005718614A

United States Patent [19]

Armond et al.

[11] Patent Number: 5,718,614

[45] Date of Patent: Feb. 17, 1998

[54] CONTROL APPARATUS FOR GRINDER

[75] Inventors: Joseph A. Armond, River Grove; Juanito Rodenas, Carol Stream, both of Ill.

[73] Assignee: Electro-Matic Products Company, Chicago, Ill.

[21] Appl. No.: 520,213

[22] Filed: Aug. 28, 1995

[51] Int. Cl.[6] ..... B24B 51/00

[52] U.S. Cl. ..... 451/5; 451/11; 451/15; 451/179; 451/213; 451/363

[58] Field of Search ..... 451/5, 9, 10, 11, 451/15, 179, 213, 214, 363, 392

[56] References Cited

U.S. PATENT DOCUMENTS

| | | | |
|---|---|---|---|
| 4,643,622 | 2/1987 | Winski | 451/11 X |
| 4,989,376 | 2/1991 | Armond et al. | 451/11 X |
| 5,072,550 | 12/1991 | Matsumoto | 451/11 X |
| 5,265,380 | 11/1993 | Datum et al. | 451/11 |
| 5,402,607 | 4/1995 | Lombard | 451/11 X |

*Primary Examiner*—Timothy V. Eley

*Attorney, Agent, or Firm*—Daniel J. Hulsberg; Mayer, Brown & Platt

[57] ABSTRACT

Downfeed apparatus in a grinder controlling the grinding wheel down in fast, medium and slow speeds, and up in fast speed. It is fed down continuously in successive passes throughout the grinding operation, and at the end of the grinding, the grinding wheel continues through a spark-out mode at a constant level. A previous control program is held in a memory for later use in an identical operation on an identical workpiece. A monitor presents all steps taken in every mode and every step, and shows progress of movements enabling the operator to manually set and adjust the control apparatus simply and accurately by watching the monitor while making the adjustments. The monitor also continuously presents all movements in an automatic operation.

11 Claims, 7 Drawing Sheets

242
SEE FIG. 10
SEE FIG. 12
R1
R2
R5
256
230
237
286b
286
286a
292
298
293
294
295
350
311
313
312
329
328
262
284
257
267
264
265
270
272
324
296
314
346
347
349
344
343
323
352
331
321
325
326
338
339
341
357
358
286c
D1
D2
D3
D4
D5
D6
D7
D8
D9
D10
D11
D12
D13

TERMINAL CODE
MAIN
PCB
ELECTRONIC COUNTER (EMCRT)
RELAY
ENCODER
SWITCH PANEL

CR
242
SPARK OUT
SSRB
CYCLE START
335
BYPASS
259
280
316
SLOW
UP
260
278b
278
CRG
STOP
R
MED
289
FAST
282
BYPASS
SLOW
UP
(SLOW)
(FAST)
TABLE/CS
TABLE
CROSSSLIDE
G
Y
SEE FIG. 11
279
EMCRT
FST
SLW
SBY
DWE
MONITOR
VIDEO IN
246
CS
GND
341
354b
355b
318
319
287
310

CONTROL APPARATUS FOR GRINDER

FIELD OF THE INVENTION

The invention resides in the general field of machine tool controls. The invention is particularly adaptable to a grinder, and more particularly to the control of the movements of the grinding wheel in various phases of a grinding operation. Such movements include advancing and reversing movements, fast and slow movements, and starting and stopping. This kind of apparatus is popularly known as a downfeed.

SUMMARY OF THE INVENTION

The invention has to do with controlling the moving parts of a machine tool. The apparatus of the invention has particular use in a grinder that has a reciprocating table for holding the workpiece to be ground, and a grinding wheel that is fed down into engagement with the workpiece on the table. It is to be understood of course that the apparatus is not limited to a grinder, but may be used in other machines having moving parts, for controlling the movements of those parts.

The table is reciprocated both in left/fight directions, and in in/out directions. The grinder performs two different forms of grinding operations, a) surface grinding, and b) plunge grinding. Usually the grinding wheel is narrower than the workpiece, and in a), in one pass of the grinding wheel over the workpiece, a strip is ground narrower than the workpiece; between passes, the grinding wheel is held at a constant level, and the table is moved, in or out, and passes are made across the table. The step is repeated with the grinding wheel in one or more lowered positions. In b), the table is reciprocated left/right, and not in/out, and the grinding wheel is lowered after each pass, resulting in a groove the width of the grinding wheel extending throughout the length of the workpiece.

The steps in the grinding operations are controlled selectively manually and automatically, and the present apparatus is capable of controlling these steps, and additionally and importantly, the apparatus includes a video monitor for recording the settings of the controls and enables visual observation thereof. The operator can then easily and quickly observe the settings and quickly calculate the new or additional settings that need be made. Moreover, included in the controls are means for automatically repeating a complete sequence of operating steps according to previous settings.

BRIEF DESCRIPTION OF THE INDIVIDUAL FIGURES OF THE DRAWINGS

DETAILED DESCRIPTION

Figure 1:
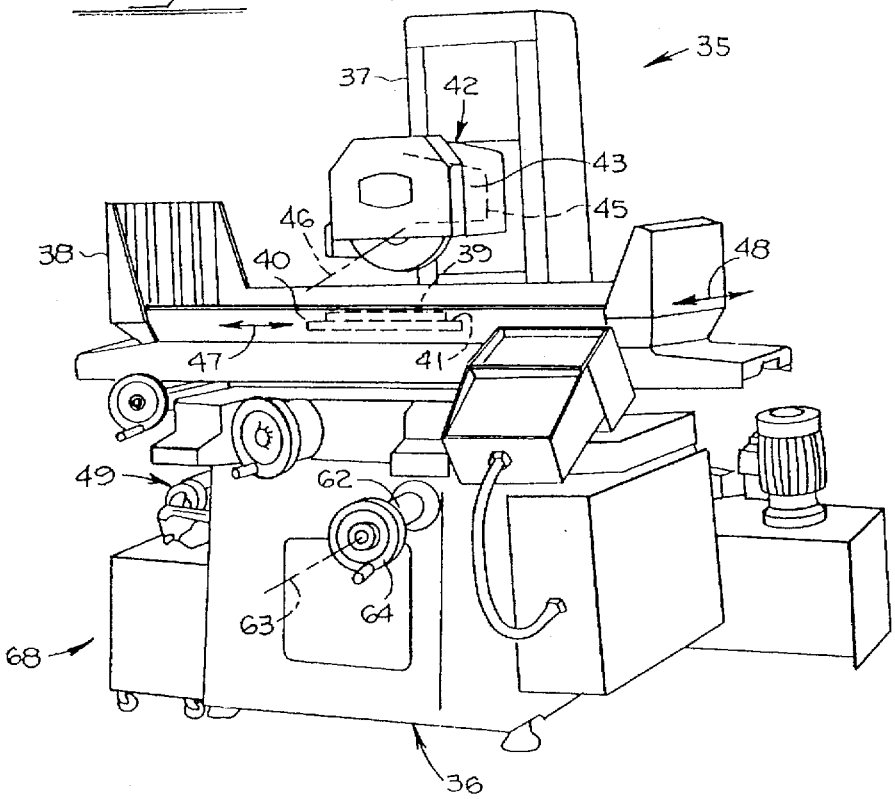
FIG. 1 is a perspective view of a grinder to which the apparatus of the invention is applied.

A grinder of the kind to which the apparatus of the present invention is applicable is disclosed in U.S. Pat. No. 4,989,376, dated Feb. 5, 1991, the present inventors Armond and Rodenas being co-inventors named in that patent. The main components of the grinder itself of that patent are shown herein, but certain simplifications are utilized in the present disclosure, for convenience.

Referring to the electrical and electronic circuit, reference numerals 1–33 are applied to electronic counter terminals. Certain of these terminals and reference numerals occur at more than one location in the circuitry, but those of the same number are a single terminal in the physical construction, and appear at different locations in the circuit for convenience. Other elements are identified with the numerals beginning with 35. The circuit includes pushbuttons, or manual switches, identified by the letters A, B, C, and the contacts thereof by the numerals 1, 2,3,4.

The grinder as a whole is indicated at 35 and includes a base or stand 36, and a column 37 at the rear, adjacent the center thereof. The grinder includes a table 38 having a magnetic chuck 40, the latter having an upper surface 41. Usually the chuck extends above the supporting surface of the table, and the workpiece is placed on the chuck. The chuck surface therefore will be utilized herein as a basic level in referring to positioning and dimensions.

Mounted in the column 37 is a grinding head 42 which includes a body 43 and a grinding wheel 44, driven by a motor 45, the wheel being rotatable on an axis 46 extending horizontally from front to rear. The grinding head is so mounted for vertical movement for feeding, or bringing the grinding wheel downwardly into engagement with the workpiece, and upwardly in a retracting direction, as will be referred to again.

The table 38 is reciprocable left/right longitudinally of the table, as indicated by the double headed arrow 47, and in/out, in a direction transverse to the length of the table, as indicated by the double headed arrow 48.

Figure 4:
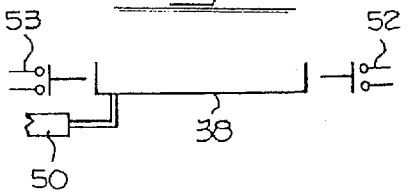
FIG. 4 is a diagrammatic detailed view of the reciprocating table and related elements oriented according to FIG. 3.
Figure 5:
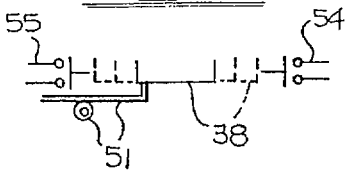
FIG. 5 is a diagrammatic detailed view of the reciprocating table and related elements oriented according to FIG. 2.

The rotation of the grinding wheel and the movements of the table 38 are effected by the components provided in the standard grinder, such as a hydraulic pump 49 (FIG. 1), and for example a hydraulic motor 50 (FIG. 4) directly driving the table in left/right directions, and an electric motor, represented by a rack and pinion 51, directly driving it (FIG. 5) in in/out directions.

The reversing movements of the table are accomplished by known means in the grinder, which includes switches 52, 53, in the case of left/right movements, and switches 54, 55, in the case of in/out movements. These switches are actuated by the table, and they are adjustable for predetermining the range of such movements.

The apparatus of the invention is concerned with controlling the bodily movements of the grinding wheel, from one location to another, as distinguished from rotation thereof, and unless otherwise indicated, references to movement of the grinding wheel hereinbelow will be to such bodily movement, and specifically controlling movement of the grinding wheel into grinding engagement with the workpiece, and in other directions, and to other positions.

Although the grinder to which the apparatus is applied is a standard grinder, for convenience the essentials of that grinder are next referred to, which will be followed by a description of the mechanical and electrical aspects of the apparatus of the present invention.

Figure 2:
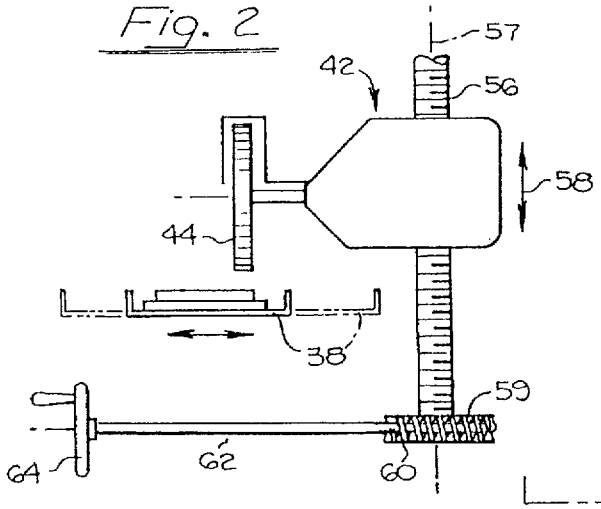
FIG. 2 shows certain elements of the grinder, including the reciprocating table and grinding head, isolated from the grinder, and oriented according to a view from the right of FIG. 1.
Figure 3:
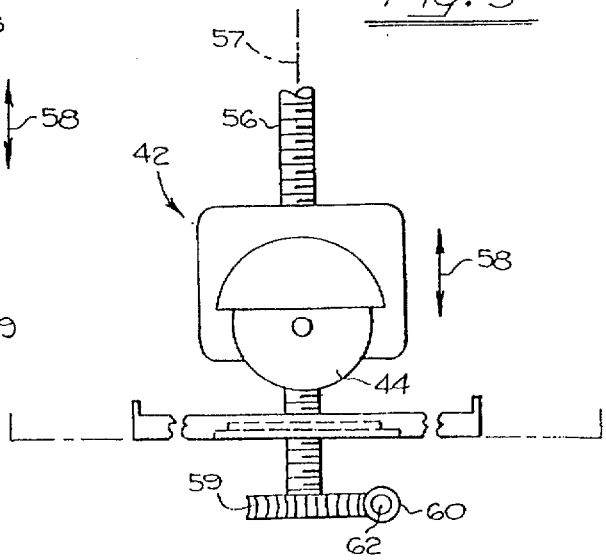
FIG. 3 is a view from the left of FIG. 2, showing these elements from the front.

The grinding head 42 is mounted for movement by a vertical lead screw 56 (FIGS. 2, 3), the axis of which is shown at 57, for vertical movement as indicated by the double-headed arrow 58. Mounted on the lead screw is a worm gear 59 driven by a worm 60 on the usual horizontal cross shaft 62, the cross shaft leading to the exterior at the front (FIG. 1) where a hand wheel 64 is mounted thereon, the axis of the cross shaft being indicated at 63. In initial steps in using the grinder, the operator manually positions the grinding head vertically by the hand wheel, in a known manner, it being pointed out that various control elements of the present control apparatus are directly related thereto, for producing the intended control movements.

Figures 12, 13:
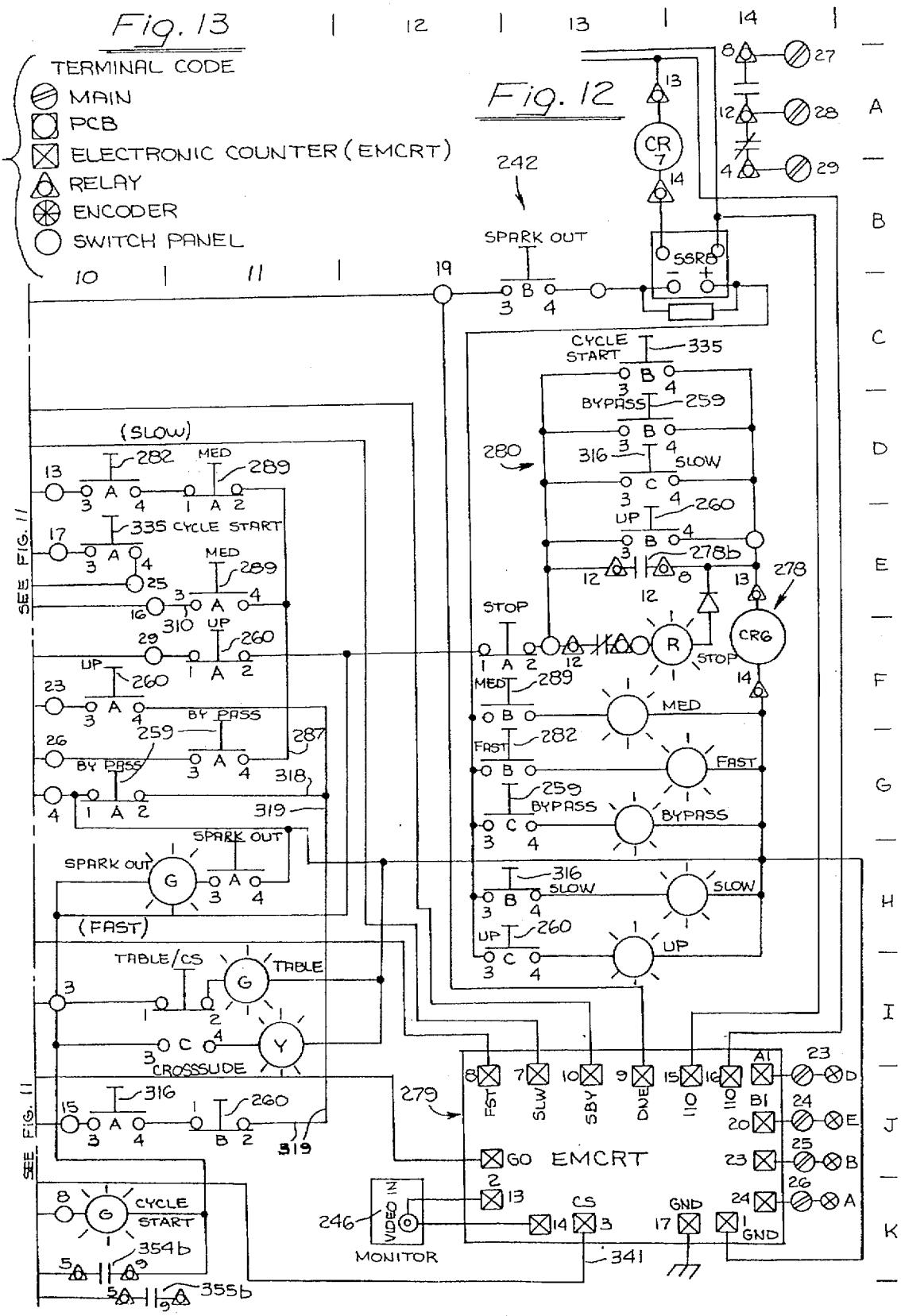
FIG. 12 is another portion of the control circuit.
FIG. 13 is a terminal code relating to FIGS. 10–12.

Referring to the broad concept of the invention, the apparatus includes means for driving the lead screw, an electronic encoder driven by the lead screw, and a microcontroller and counter 279 coupled to manually manipulatable control elements. An electrical circuit and an electronic circuit are included, the electrical circuit as used herein including the electronic circuit. As the lead screw is rotated, and in response to control signals being entered in the electrical circuit, the microcontroller and counter 279 controls further rotation of the lead screw. The encoder is shown diagrammatically at 77, and the microcontroller and counter 279 is shown at FIG. 12.

Figure 6:
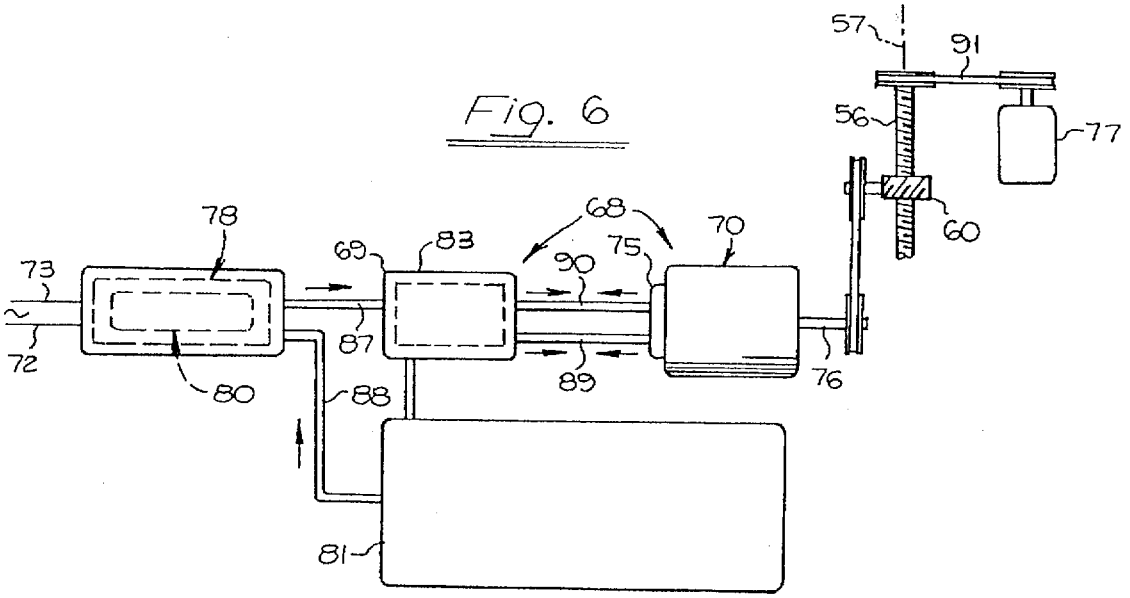
FIG. 6 is a flow sheet of the drive transmission (See FIG. 10).
Figure 6A:
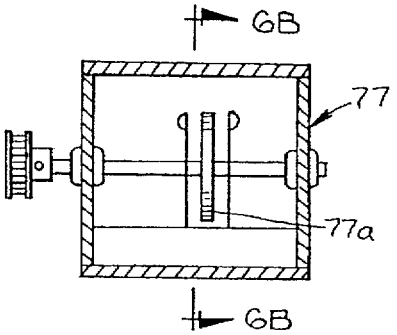
FIG. 6A is a semi-diagrammatic sectional view of the encoder.
Figure 6B:
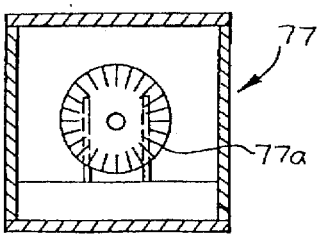
FIG. 6B is a view taken at line 6B—6B of FIG. 6A.
Figure 8:
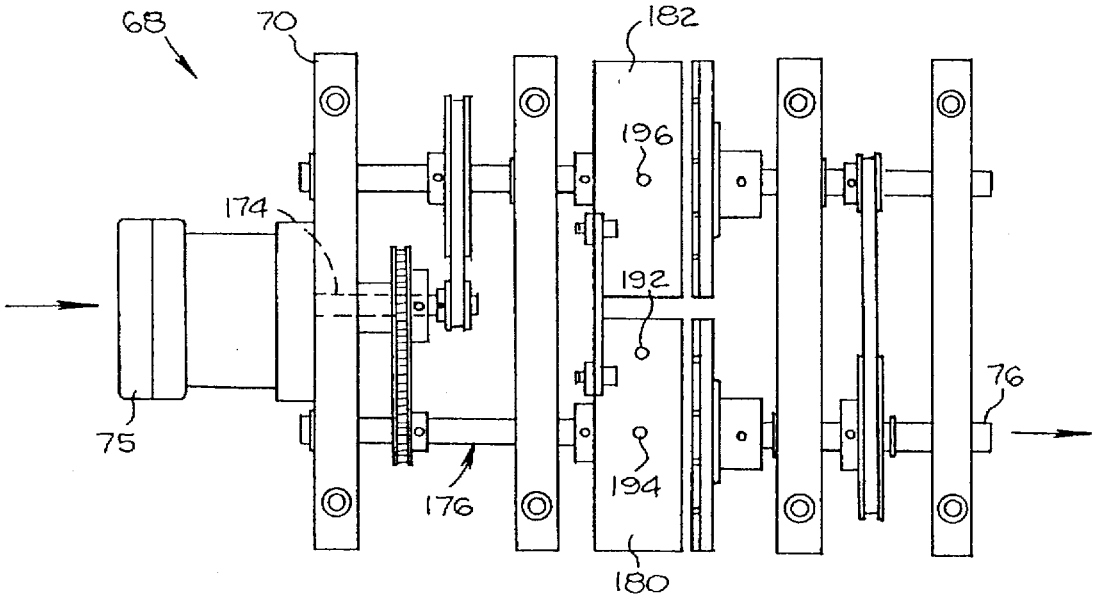
FIG. 8 is a semi-diagrammatic view of the mechanical transmission unit.
Figure 9:
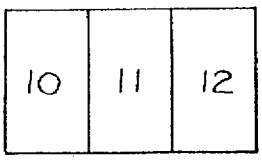
FIG. 9 is a layout of the positional relationship of the circuitry of FIGS. 10–12 that include portions of the electrical circuit.

As a statement of the general operation, the power for driving the encoder is derived from the pump unit 49 and is transmitted through transmission means 68 (FIG. 6) which includes a hydraulic motor 75. The input to this hydraulic motor is through fluid lines 87, 88, and the output is through fluid liner 89, 90 to a rotatable mechanical output element or hydraulic motor 75. The output element 75 drives the transmission 70 (FIGS. 6, 8), and the latter has an output element 76 from which the drive is transmitted to the lead screw. The drive then continues from the lead screw to the encoder 77 through a belt 91. The encoder 77 is known as an Optical Incremental Shaft Position Encoder sold by Fork Standards, Inc. The encoder is shown in diagrammatic form because it is believed not necessary to describe it in detail. Briefly, this component contains certain electronics interacting elements having interconnection with the circuit of FIGS. 9–12. The encoder has a rotary disc 77*a* (FIGS. 6A, 6B) that is driven by the lead screw 56 in both directions, and it indicates the position of the lead screw which corresponds to the position of the grinding wheel.

The character of the encoder is such that as its shaft and disc 77*a* is rotated by means of the lead screw, the encoder produces pulses which is fed into the microcontroller and counter 279. The microcontroller and counter 279 counts these pulses and determines how much and what direction the encoder shaft has been rotated. Therefore, the exact position of the grinding head is determined and also displayed in the monitor. The operator of the grinder manipulates certain control elements, this step being effective for programming dimensions or numbers into the microcontroller and counter 279. When the position of the grinding head corresponds to a certain programmed dimension, a function is performed accordingly.

Figure 7:
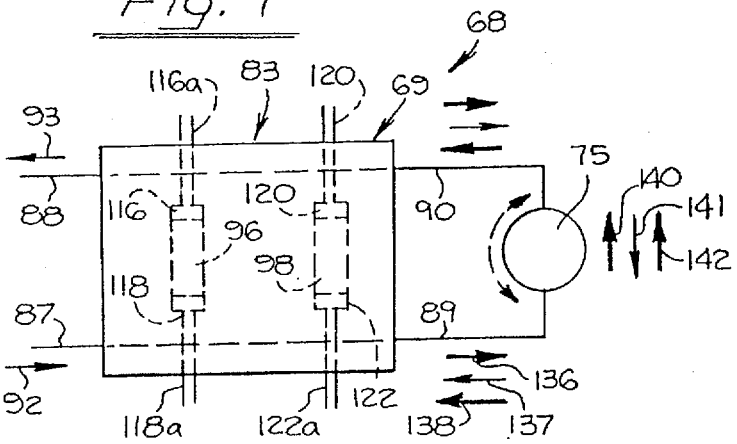
FIG. 7 is a semi-diagrammatic view of the hydraulic transmission unit.

Referring again to FIG. 6, an electrical motor 78 is connected with a suitable electrical source 72, 73. The motor drives a unidirectional hydraulic pump 80 which may be a gear pump, and a reservoir 81 is provided for the hydraulic fluid. The pump 80, which may also be referred to as a pump unit, pumps the hydraulic fluid for driving the transmission 70. The flow of the hydraulic fluid is controlled by a valve assembly 83 incorporating a set of hydraulic valves (FIG. 7).

Briefly, the hydraulic motor 75 and mechanical transmission 70 constitute motion transmitting means between the electric motor 78 and the lead screw. The valves of FIG. 7 and the details thereof are disclosed in detail in the patent identified above.

Hydraulic lines 87, 88 communicate with the pump 80, valve assembly 83, and reservoir 81, forming a closed hydraulic circuit in those three components. In one mode, an idling mode, the fluid from the pump may be rerouted in the valve assembly and recirculated to the pump without producing any driving force. In other modes, or settings of the valves, the fluid is pumped through one of the additional lines 89, 90 (FIG. 7) to the output element 75, and from the latter it is returned through the other of the lines 89, 90 to the valves, and then through the recirculation system in return to the reservoir 81.

The hydraulic pump 80 operates constantly, and the hydraulic valves of the valve assembly 83 controls transmission of fluid, according to whether the grinding wheel is to be moved.

The fluid recirculated through the hydraulic lines 87, 88, is so recirculated at a constant rate. However, the fluid from the valve assembly 83 to the hydraulic motor 75 is selectively driven in reverse direction, and at fast, and slow rates. This fast/slow movement of the fluid determines the rate of vertical movements of the grinding head, as referred to again hereinbelow. However, it is pointed out here, that the grinding head is retracted, or lifted, always at a fast rate, but it is fed downwardly at selectively fast, medium and slow rates. It will be noted that in FIG. 7, heavy and light arrow lines are used in one direction in the additional lines 89, 90 to suggest that the rate may be varied, and whereas only a heavy arrow line is shown in the opposite direction to suggest only a fast rate.

A comparison is made between the unit 83 and the unit 70. The valves in the assembly 83 are arranged for selectively reversing the fluid flow, and thereby reversing the direction of drive, and also are arranged for providing fast flow and slow flow, selectively, of the fluid to provide respectively fast and slow drive. However, the mechanical unit 70 is capable of producing fast and slow transmission therethrough, independently of the valves, and as a result, variation in speeds is provided as between fast movement through the valves and through the mechanical unit, and slow movement through both of those units, selectively, as referred to again hereinbelow. The fast movement can be provided in each of opposite directions.

In the hydraulic transmission unit 83 (FIG. 6) are two valve units 96, 98, each having two positions and each position individually represents a "valve." Each position is established by a solenoid, and the operable four solenoids are identified as 116, 118, 120, 122. These solenoids are indicated in FIG. 7 and appear in the circuit at C-1, D-1, E-1, E-1 The circuit conductors for the valves are indicated at 116*a*, 118*a*, 120*a*, 122*a*, these hydraulic valves being thus operated by the circuit of FIGS. 10–12.

Referring to the specific operation of the hydraulic unit, when the solenoids 116, 118 are both energized, the output element 75 is driven fast forward; when only solenoid 118 is energized, it is driven slow forward; when solenoids 120, 122 are both energized, it is driven fast in reverse, and when no solenoid is energized, the fluid merely recirculates and the output element remains stationary.

With reference to the mechanical unit 70, (FIG. 8) this unit does not have any internal elements for controlling the direction of output, and is driven in each of opposite directions according to the direction of drive of the element 75 of the hydraulic unit.

The mechanical unit has an input shaft 174 driven by the output element 75. It has an idler shaft 176, and an output shaft 76 identified above. It also includes electromagnetic clutches 180, 182 for selectively driving the output shaft at different speeds, and a pulley system with step-up ratios for controlling the different output speeds. The electromagnets of the clutches include terminals 192, 194, 196, and are found in the electrical circuit at (H-2, I-2); details of the unit may be found in the patent identified above.

The reduction in speed through the mechanical transmission unit 70 is cumulative with that achieved through the hydraulic unit 68 (FIG. 1) and the two together provide an extremely great variation as between the output of the pump leading into the hydraulic unit and the output of the mechanical transmission unit. As a result, the increments of feeding the grinding wheel toward the workpiece are extremely small; the various parts or elements in the present instance are preselected so as to provide increments as small as 0.000050".

Figure 10:
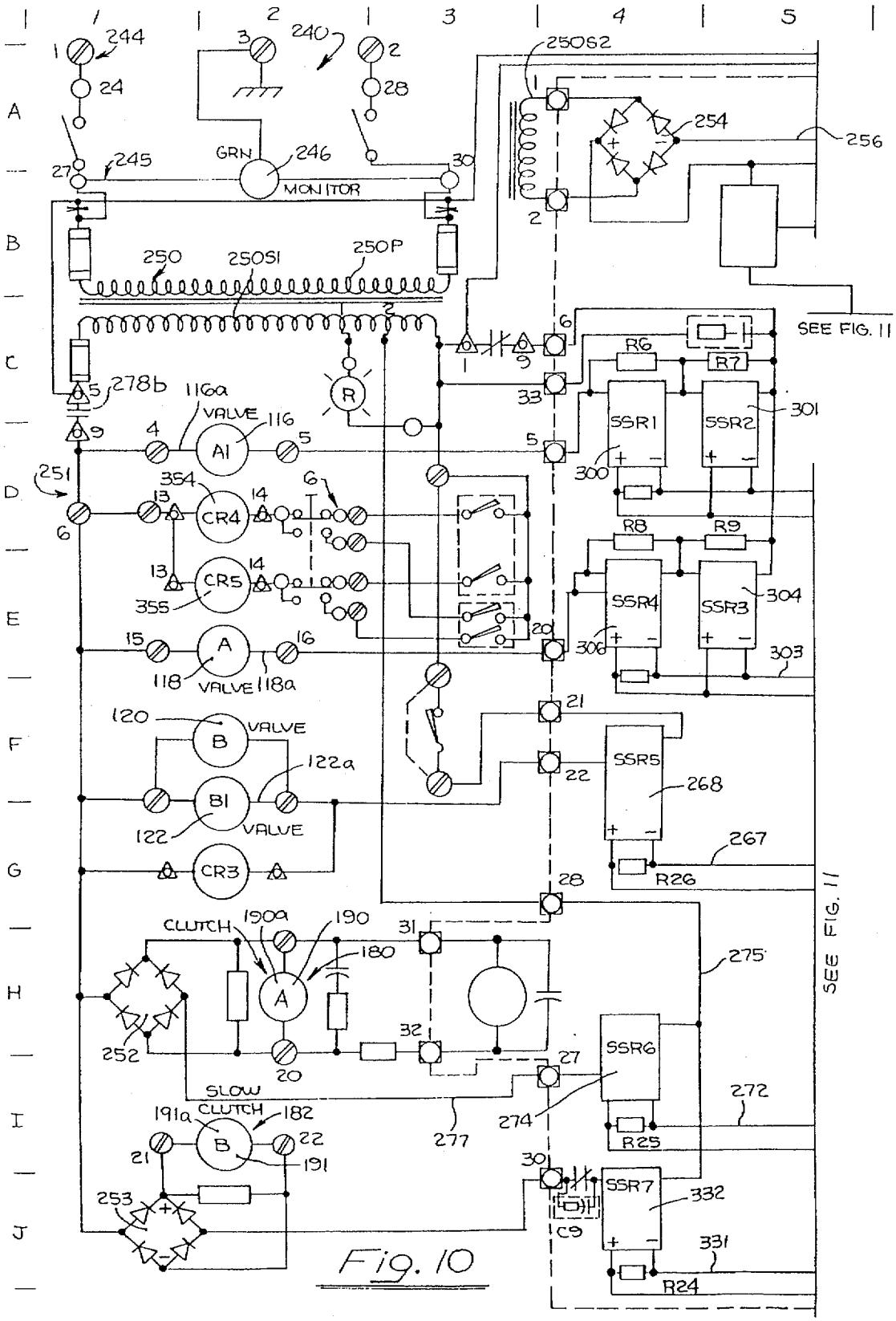
FIG. 10 is a diagram of the power circuit included in the overall circuitry.
Figure 11:
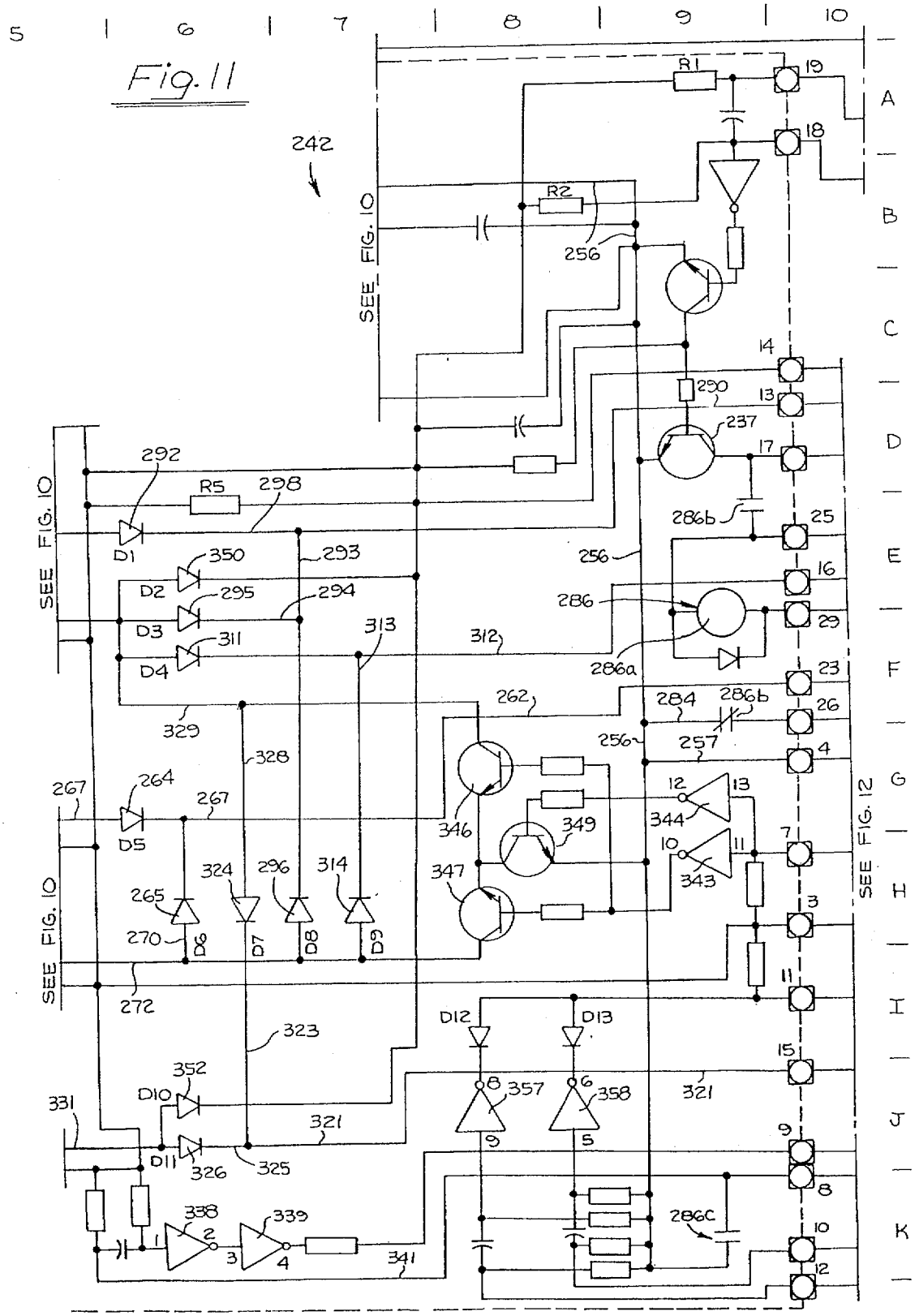
FIG. 11 is a portion of the control circuit.

Reference is next made to the circuitry of FIGS. 10–12. The circuitry is divided into two main parts, namely a power circuit 240 of FIG. 10 and a control circuit 242 of FIGS. 11–12.

In the identification of the transformer, this item is designated generally with reference numerals and the primary winding and secondaries 4 with the same reference numerals with the postscripts P and S respectively, and in the case of the latter, the postcripts include the numerals 1, 2, etc., for multiple secondary windings. In a similar manner, relays are given reference numerals as a whole, the coils given the same reference numerals with the postscript a, and the contacts the same reference numerals with the postscripts b, c, etc.

The SCR's transistors, rectifiers, triacs, diodes and gates, may be referred to generically as valves.

The circuitry (FIGS. 10–12) is provided with coordinates at the boundaries of the sheets to facilitate locating the elements referred to. The particular coordinates follow the reference numerals of the elements identified.

Figure 14:
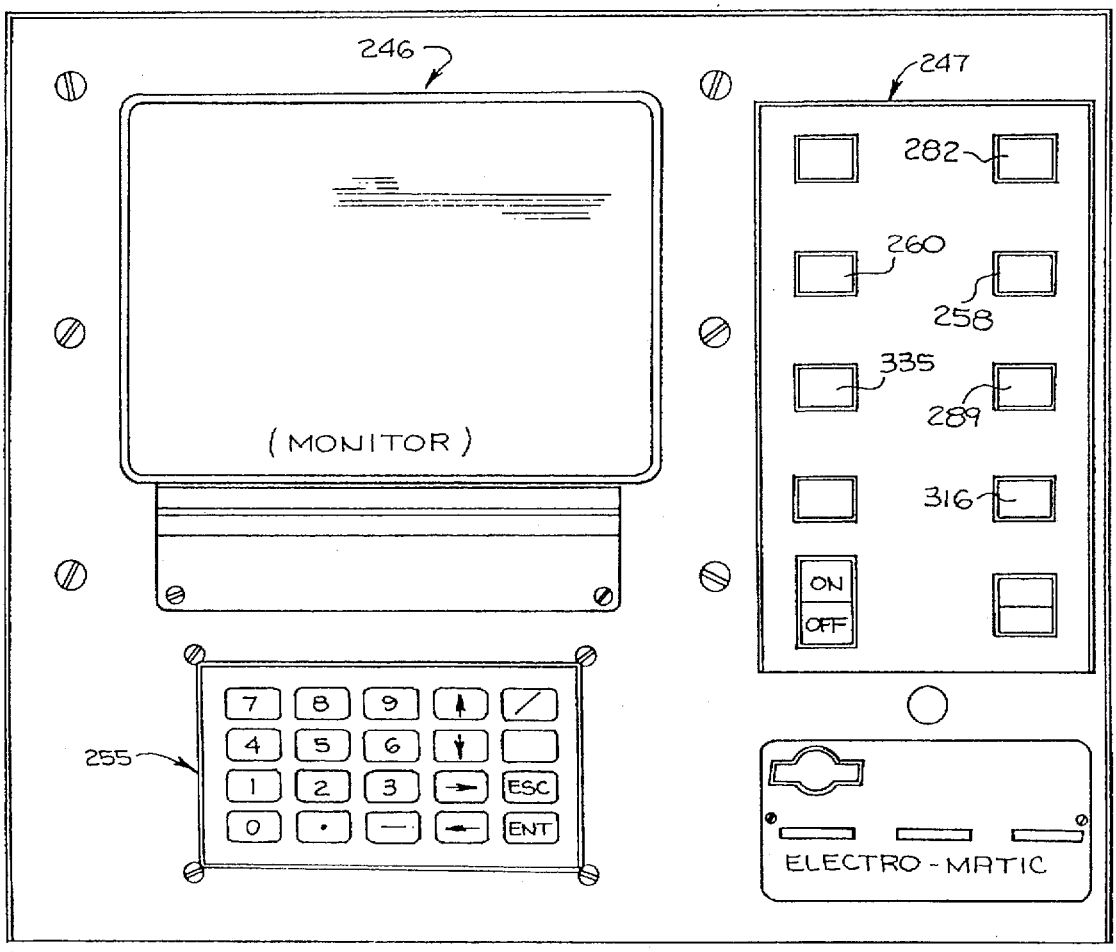
FIG. 14 is face view of the monitor and control panel

The power circuit 240 includes a main AC source 244 of for example 120 VAC leading to a sub circuit 245 which includes a monitor 246 referred to again hereinbelow (FIGS. 12, 14).

The power circuit includes a main transformer 250 which includes a first secondary 250S1, of 95 VAC.

Leading from the secondary 250S1 is another sub circuit 251 which includes the solenoids 116, 118, 120, 122 identified above. Also incorporated in the power circuit (FIG. 10) are the clutches 180, 182, identified above, and rectifiers 252, 253 providing DC of suitable voltage, for the clutches. The power circuit includes another secondary 250S2 (A-4) for providing suitable power, such as 15 VAC, for a portion the control circuit (FIGS. 10–12). The output of the secondary 250S2 leads to a rectifier 254 (A-4) which provides DC of 20V for another portion of the control circuit. The power circuit includes other control components and elements, as will be referred to hereinbelow in the description of the control operations.

Incorporated in FIG. 12, (I-12) is the microcontroller and counter 279 which constitutes the central control or "brain" of the circuitry. FIG. 12 includes de monitor 246 (see also FIG. 14), and the encoder 77 which is coupled to the terminals D, E, B, A. FIG. 12 (J-14). The microcontroller and counter 279 illustration in FIG. 12 (J-12 14) also includes the electronic terminals 8, 7, 10, 9, 15, 16 in controlling relation to various components in the part of the circuitry of FIG. 12.

As referred to above, the encoder is driven by the power that drives the grinder itself, and is advanced and retracted with the grinding (FIG. 6) wheel. The microcontroller and counter 279 includes such built-in characteristics that in response to the encoder feeding and advancing, and retracting, movements, signals are stored therein according to movements of the parts of the grinder, and also according to manual control manipulations, and the microcontroller and counter 279 then later performs control functions on the grinder according to the signals so stored.

FIG. 14 is a face view of a panel that is mounted on the grinder for direct use by the operator. This panel includes the monitor 246. Additionally it includes a set of switches shown in a small panel 247 that includes the manual switches included in FIG. 12 and described above. From a functional standpoint, the encoder is considered to be incorporated in the microcontroller and counter 279 (J-13, FIG. 12), but in the physical construction of the apparatus the parts are in two different units and may be mounted as desired.

The component 255 is shown in FIG. 14 with the monitor 246. FIG. 14 also includes the pushbuttons, also referred to as manual switches, at the right of FIG. 12, (C-13 to H-13).

In the following description of the circuitry, the visible potion of the circuitry and its operation are described as in association with the functioning of the EMCRT according to the characteristic built-in functioning of the latter.

The control circuitry (FIG. 12) includes manual switches labeled according to modes of operation of the grinder. These switches are shown duplicated and distributed in the circuitry according to the functions of their respective poles and contacts. FIG. 14 shows these switches as pushbuttons in the structural display.

The grinder, as controlled by the apparatus, assumes predetermined conditions, or attitudes, which are referred to herein as MODES according to the functions to be performed. These MODES include:

UP MODE
FAST APPROACH MODE
MEDIUM APPROACH MODE
SLOW APPROACH MODE
CYCLE START MODE

Following are individual descriptions of the MODES.

UP MODE

As the first step in this mode, the UP switch 260 is actuated (D-13, E-11, F-10, J-11, H-13). The negative side of the 12V power supply, rectifier 254 (A-4), is connected through conductor 256, conductor 257 (G-9) to terminal 4 (G-10). The connection then passes through the contacts of normally closed pole A (G-10) of BYPASS push button 259, and then through the open pole A (F-10) of the LIP switch 260, to terminal 23, conductor 262 and through diodes 264 (G-6) and 265 (H-6). Leading from the diode 264 is a conductor 267 to SSR 268 (Solid State Relay) (F-4), which is thereby triggered ON, the 115 VAC from the transformer 250 (B-1) energizing the valves 120 and 122 (F-1).

The diode 265 (H-6) is in a conductor 270, connected across the conductor 267 and another conductor 272, the latter leading to an SSR 274 (H-4), and at the same time that the previous step took place, i.e. energizing the valves 120, 122.

The SSR 274 is thus turned ON, and acting through conductor 275 conducts 100 VAC from the main transformer secondary 250S1. This connection continues through the conductor 277 to the rectifier 252 (H-1) and the electromagnetic clutch 190 is energized and engaged. As a result, the grinding head moves upwardly.

Anytime the UP switch 260 (D-13) is actuated, it energizes a relay 278 (E-14) which is latched closed by the contacts **278*b* (E-13). This relay is energized and latched in at other steps also, as indicated by the sub circuit 280 at the upper right hand side of FIG. 12** and as will be referred to again hereinbelow.

FAST APPROACH MODE

In this MODE, two push buttons are utilized, namely, FAST 282 (F-13) and BYPASS 259 (G-13), which are pushed in at the same time. In this MODE, the negative from the rectifier 254 (A-4) continues through conductor 256, to conductor 284 (F-9) through the NC contacts **286*d* (F-9) (see 286 F-9) to terminal 26, then through the N/O contacts of pole A (G-11) of BYPASS pushbutton 259. It then continues through conductor 287 to the N/C pole A (D-11) of the MED (medium) pushbutton 289, through the N/O pole (D-10) of the FAST pushbutton 282. It then proceeds to terminal 13, and through conductor 290 to diode 292 (E-6). It also continues from conductor 290 to conductors 293, 294 to diode 295 (E-6; the conductor 293 leads to another diode 296 (H-7). From the diode 292, a conductor 298 leads to SSRs 300, 301 (D-4) which are mined ON, thus energizing the valve 116. From the diode 295 (E-6) a conductor 303 leads to SSRs 304, 306 which are switched ON and which then energize the valve 118 (E-1). Also, through the diode 296 (H-7) the SSR 274 (H-4) is turned ON, which energizes the clutch 180** (H-2). This actuation of the clutches brings the grinding wheel down at a fast speed.

MEDIUM APPROACH MODE

In this MODE the MED pushbutton 289 (F-13) and the BYPASS pushbutton 259 (G-13) are pushed in at the same time. From the negative side of the 12V rectifier 254 (A-4) the circuit continues through conductor 256, to conductor 284 (F-9) and N/C contacts **286*b*(F-9), (see 286, E-9), then through terminal 26, N/O pole A BYPASS pushbutton 259, conductor 287, of pushbutton 289 N/O pole A (E-11 ), then continuing through conductor 310 to terminal 16; it then proceeds through conductor 312 to diode 311 (F-6), which turns on SSR 304 and 306 (E-4). Valve 118 (E-2) is energized. Also through conductor 313 (E-7) to diode 314 (H-7), SSR 274 (H-4) is turned ON, thereby energizing and engaging the clutch 190** (G-2). This results in the grinding wheel going down at a medium speed.

SLOW APPROACH MODE

The SLOW pushbutton 316 (D-13) is pushed in. From the negative side of the 12V rectifier 254 (A-4) the circuit continues through conductor 256, to the conductor 257 (G-9) and terminal 4, through the N/C pole A (G-10) BYPASS pushbutton 259, conductors 318, 319, to N/C pole B (J-11) of UP pushbutton 260, through N/O pole A (I-10), SLOW pushbutton 316; it continues through conductors 321,323 to diode 324 (H-6); the conductor 321 continues to conductor 325 (J-6) and diode 326. From the diode 324, conductors 328, 329, 303, the SSRs 304, 306 (E-4) are switched ON. This succession thereby energizes and engages valve 118 (E-2). From the diode 326 (J-6) a conductor 331 switches on SSR 332 (J-4) this SSR energizing the clutch 182 (I-2). Thereby the grinding wheel goes down at a slow speed.

CYCLE START MODE

To initiate this MODE, the CYCLE START (CS) pushbutton switch 335 (C-13) is actuated; this energizes the relay 278 (E-14) and closes the N/O contacts **278*b* (E-13). In this step the N/O contacts of pole A (D-10) of the C/S pushbutton 335 are closed, energizing the relay 286 (E-9). This relay is latched ON by means of its N/O contacts. Through the N/O contacts 286*c* (K-9), (see relay 286, F-9), a pulse is transmitted to pin 1 of a gate 338 (K-6), being pulsed LO for about ½ second. Thereupon through pin 4 of gate 339 (K-6) the LO signal passes through conductor 341 to CS terminal 3 (K-13) which is the input terminal to the microcontroller and counter 279**.

The FAST output of the microcontroller and counter 279 becomes active, and sends a LO signal to the terminal 7 (H-10). The outputs of gates 343 (H-9), 344 (G-9) become HI and the transistors 346 (G-8), 347 (H-8) and 349 (H-8) are turned ON. By means of the transistor 346, the SSRs 304, 306 (D-4) are triggered ON, energizing the valve 118 (E-2). Acting through transistor 347 (H-8) the SSR 274 (H-4) is also triggered on, thereby energizing and engaging the clutch 180. Consequently the grinding wheel comes down at a medium speed.

Upon reaching a programmed distance between the wheel and top surface of the workpiece, the FAST output of the microcontroller and counter 279 becomes inactive, and the transistors 346 (G-8), 347 (H-8) and 349 (H-8) are all turned off, and the wheel stops its downward approach.

At this point the SLOW output of the microcontroller and counter 279 becomes active, thereby putting a LO signal to the terminal 14 (C-10). This LO signal goes through the diode 350 (E-6) and diode 352 (J-6) and triggers the SSRs 304, 306 (E-4) and SSR 332 (J-4). As a consequence, the valve 118 (E-2) is actuated and the clutch 191 (I-2) is engaged. Accordingly, the grinding wheel will continue its downward approach but at a much slower speed.

Upon the grinding wheel reaching a preprogrammed figure, the microcontroller and counter 279 will terminate the LO signal from its slow output (J-13) at terminal 7. Consequently the SSRs 304, 306 (E-4) and 332 (J-4) will turn off. The wheel stops its downward approach directly at or on the top surface of the workpiece.

Depending on the grinding mode selected by the operator, i.e. whether surface or plunge grinding the relay 354 (D-2) or the relay 355 (E-2) will be energized, each time the table reverses its direction. Through the N/O Contacts **354*b*, 355*b* of these relays (K-10)(K-11) the output of either gate 357, 358** (J-8) will become LO. This LO signal is sent to terminal 11 (I-10) and then to the GO input of microcontroller and counter 279 (J-12). After receiving the GO signal, the microcontroller and counter 279 slow output at terminal 7 (J-13) becomes active which rams on SSRs 304 and 306 (E-4), thus energizing valve 118. At the same time, SSR 274 (I-4) will turn on which engages clutch 180 (H-2). As a result, the grinding wheel will downfeed until the programmed feed rate entered into the microcontroller and counter 279 is reached, whereupon the slow output at terminal 7 (J-13) becomes inactive.

The above sequence is repeated again on the next table reversal.

When the programmed total cut is obtained the "slow" output of the microcontroller and counter 279 is deactivated and there is no further downfeed of the grinding wheel.

The grinding wheel will make several passes across the workpiece according to the program entered on the microcontroller and counter 279 for spark-out cycle. At the last table reversal, the "done" output at terminal 9 of the microcontroller and counter 279 (J-13) is activated which turns on SSR8 (B-14). Relay CR7 (A-13) is energized, and its contacts are used to terminate machine function/s. This notifies operator that the grinding process is finished.

We claim:

1. Control apparatus for a grinder wherein, the grinder includes a reciprocable 0table for holding workpieces, driving means for the table, a grinding wheel and means for rotating it, moving means for translationally moving the grinding wheel in vertical directions, said control apparatus comprising:

a transmission operably connected between the moving means and the grinding wheel;

a microcontroller and counter;

a monitor screen;

electrical circuitry operably interconnecting the moving means, the microcontroller and counter, and the monitor screen;

manual means for initiating and terminating driving the moving means and correspondingly moving the grinding wheel, the grinder includes the following components for moving the grinding wheel as stated, a) fast advance, b) slow advance, c) fast retract, d) holding stationary; and means for recording movement of the grinding wheel and displaying such movement on the monitor screen, the recording means includes means for recording the positions of the grinding wheel continuously, means for controlling said components individually, and manually actuatable means for initiating control of the microcontroller and counter for selectively controlling said components.

2. Control apparatus according to claim 1 wherein, the grinding wheel is moved downwardly into engagement with a workpiece and upwardly in a retracting direction, and the circuitry is operable for moving the grinding wheel downwardly at both fast and slow speeds, and moving it upwardly at fast speed.

3. Control apparatus according to claim 1 wherein, the circuitry includes manually controlled electrical means for controlling movement of the grinding wheel downwardly to a predetermined first position, and manually settable means for automatically controlling movement of the grinding wheel downwardly from said first position to a predetermined second position.

4. Control apparatus according to claim 3 wherein, the grinding machine including means for reciprocating the table, the circuitry includes means for controlling downward movement of the grinding wheel an increment between successive reciprocations of the table down to said second position, and thereafter maintaining the grinding wheel at said second position, producing a spark-out position throughout a plurality of reciprocations of the table thereafter.

5. Control apparatus according to claim 1 wherein the grinder includes a medium advance component for moving the grinding wheel.

6. Control apparatus according to claim 5, wherein, in the grinder, a workpiece on the table provides an upper surface to be ground, the grinding wheel is capable of grinding the workpiece from a top surface of the workpiece to a lower position constituting a spark-out position, and the microcontroller and counter include controls for terminating advancing movement beyond said spark-out position.

7. Control apparatus according to claim 6 wherein, the driving means is capable of reciprocating the table for producing single passes of the grinding wheel at a single level over the workpiece to form a multiple pass at such single level and the microcontroller and counter include controls for producing a plurality of multiple passes of the grinding wheel at a single level at said spark-out position.

8. Control apparatus according to claim 5 wherein, said moving components are incorporated in the transmission, and wherein, said moving components are electrically operated, and the control apparatus includes means for selectively controlling said moving components in response to pre-selected manual settings of the microcontroller and counter.

9. Control apparatus for a grinder wherein, the grinder includes a reciprocable table for holding workpieces, driving means for the table, a grinding wheel and means for rotating it, moving means for translationally moving the grinding wheel in vertical directions, the grinding wheel is vertically movable between a retracted position, and an advanced position relative to a workpiece on the table, the advanced position extending throughout a predetermined extent of the workpiece for a top surface of the workpiece and downwardly from the top surface, said control apparatus comprising:

a transmission operably connected between the moving means and the grinding wheel;

a microcontroller and counter;

a monitor screen;

electrical circuitry operably interconnecting the moving means, the microcontroller and counter, and the monitor screen;

manual means for initiating and terminating driving the moving means and correspondingly moving the grinding wheel;

means for recording movement of the grinding wheel and displaying such movement on the monitor screen; and control components selectively presettable corresponding to a predetermined cycle of moving steps of the grinding wheel including fast and medium speeds in a direction from the retracted position, slow speed throughout said advanced position, and in fast speed in a direction towards the retracted position, and the microcontroller and counter being operable for recording the cycle of moving steps, and repeatedly operating through cycles having identical moving steps whereby to enable effective grinding a successive workpiece identical to a previous workpiece without entering presettings into the microcontroller and counter for each identical successive workpiece.

10. Control apparatus according to claim 9 wherein, the control apparatus includes manually actuatable control means for recording and identifying the presettings for each of a plurality of cycles of movements, and said manually actuatable control means being operable for energization and de-energization for interruptedly and repeatedly effecting any predetermined cycle of movements.

11. Control apparatus according to claim 10, wherein, means is included for displaying in the monitor a visual program number identifying the respective cycles of moving steps recorded in the microcontroller and counter.

* * * * *